US007744366B2

(12) United States Patent
Specht

(10) Patent No.: US 7,744,366 B2
(45) Date of Patent: Jun. 29, 2010

(54) SYSTEM AND METHOD FOR IMPROVING THE THERMAL EFFICIENCY OF A HEATING SYSTEM

(75) Inventor: Werner Specht, Hermitage, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 1288 days.

(21) Appl. No.: 11/252,154

(22) Filed: Oct. 17, 2005

(65) Prior Publication Data

US 2007/0099138 A1 May 3, 2007

(51) Int. Cl.

| | |
|---|---|
| ***F23N 3/00*** | (2006.01) |
| ***F23N 1/00*** | (2006.01) |
| ***F23N 1/02*** | (2006.01) |
| ***F23N 5/00*** | (2006.01) |
| ***F23N 5/26*** | (2006.01) |

(52) U.S. Cl. ..... 431/90; 431/12; 431/18

(58) Field of Classification Search ..... 431/12, 431/18, 89, 90; 318/778, 779, 801
See application file for complete search history.

(56) References Cited

U.S. PATENT DOCUMENTS

| | | | | |
|---|---|---|---|---|
| 3,526,816 | A * | 9/1970 | Paice et al. | 318/771 |
| 3,859,578 | A * | 1/1975 | Botvinnik et al. | 318/732 |
| 3,917,989 | A * | 11/1975 | Bereisa, Jr. | 318/801 |
| 4,287,463 | A * | 9/1981 | Walker et al. | 318/803 |
| 4,311,951 | A * | 1/1982 | Walker et al. | 318/778 |
| 4,338,559 | A * | 7/1982 | Blaschke et al. | 318/805 |
| 4,426,611 | A * | 1/1984 | Espelage et al. | 318/803 |
| 4,451,112 | A * | 5/1984 | Hattori et al. | 318/778 |
| 4,456,868 | A * | 6/1984 | Yamamura et al. | 318/800 |
| 4,511,827 | A * | 4/1985 | Morinaga et al. | 318/400.23 |
| 4,675,584 | A * | 6/1987 | Kurosawa | 388/821 |
| 5,212,438 | A * | 5/1993 | Miyazaki et al. | 318/805 |
| 5,650,707 | A * | 7/1997 | Lipo et al. | 318/773 |
| 5,855,266 | A * | 1/1999 | Cummings, III | 192/58.42 |
| 5,937,979 | A * | 8/1999 | Cummings | 192/18 A |
| 5,947,247 | A * | 9/1999 | Cummings, III | 192/70.12 |
| 6,066,935 | A * | 5/2000 | Eisele | 318/773 |
| 6,329,783 | B1 * | 12/2001 | Vrionis et al. | 318/772 |
| 6,866,202 | B2 | 3/2005 | Sigafus et al. | |
| 7,242,175 | B2 * | 7/2007 | Shao et al. | 318/400.21 |
| 2007/0080653 | A1 * | 4/2007 | Wei et al. | 318/66 |
| 2008/0308472 | A1 * | 12/2008 | Osiensky et al. | 209/643 |

FOREIGN PATENT DOCUMENTS

| | | | |
|---|---|---|---|
| JP | 58224225 | A * | 12/1983 |
| JP | 02052925 | A * | 2/1990 |
| JP | 02309115 | A * | 12/1990 |
| JP | 04347411 | A * | 12/1992 |

* cited by examiner

*Primary Examiner*—Carl D Price
(74) *Attorney, Agent, or Firm*—Hoffmann & Baron, LLP

(57) ABSTRACT

A system and method for providing a heating system with good thermal efficiency by adjusting combustion air flow in response to fuel-input rate changes over a wide range. An AC motor operates in a slip mode whereby as the fuel-input rate changes, the combustion air density is affected. In response, changes in the load and thus the speed of the motor occur. Consequently, the quantity of combustion air flow increases in response to a fuel-input rate increase. The motor switches to a synchronous speed in response to the fuel-input rate reaching a set value, e.g., 70 percent of maximum rate.

6 Claims, 4 Drawing Sheets

SYSTEM AND METHOD FOR IMPROVING THE THERMAL EFFICIENCY OF A HEATING SYSTEM

BACKGROUND OF THE INVENTION

The present invention relates generally to heaters or furnaces and, more particularly, to a fuel-input modulated furnace with improved thermal efficiency.

Contemporary heating systems, for example, furnaces for space heating or make-up air heating, are generally equipped with fuel valves which can be used to modulate the fuel-input rate to the heater in order to maintain a stable and controlled temperature. This type of system generally has a limited range of fuel-input modulation. In addition, these contemporary heaters suffer from a loss of thermal efficiency as the fuel-input rate is reduced below their full fuel-input rate.

Alternatively, such controlled temperature systems may also include some type of damper to open or close a combustion air by-pass. As a result of the ability to vary the amount of combustion air accessible to the system, these systems offer a broader possible range of fuel input modulation. Typically, however, the damper has only a few static positions available, which limits the actual control over the ratio of fuel to air.

Other known heating systems provide improved thermal efficiency by controlling the supply of fuel and combustion air in predetermined incremented amounts. However, these systems are complex and costly, requiring accurate sensor systems, flow control devices such as mechanical jackshafts, and the application of algorithms and control units to regulate the thermal efficiency.

There is a need, therefore, for a system and method for improving the thermal efficiency of a heating system by controlling the quantity of combustion air in response to the fuel-input rate modulation.

SUMMARY OF THE INVENTION

The present invention, which addresses the needs of the prior art, relates to a system and method for improving the thermal efficiency of a heating system by adjusting a quantity of combustion air flow in response to a modulation of fuel-input rate over a wide range of fuel-input rates.

One aspect of the present invention relates to a method for improving the thermal efficiency of a heating system, which includes operating an alternating current electric motor in a slip mode of operation to control the quantity of combustion air flow into the combustion mixture. The speed of the motor in the slip mode, which controls the quantity of combustion air flow, proportionately varies in response to a modulation in a fuel-input rate of the system.

In one embodiment, the speed in the slip mode decreases in response to a decrease in the fuel-input rate.

In another aspect, the method also includes switching to a synchronous mode of operation in response to the fuel-input rate reaching a set value. The quantity of combustion air flow in the synchronous mode is then determined by a synchronous speed of the alternating current electric motor.

In yet another aspect, the method may further include maintaining the quantity of combustion air flow in the synchronous mode as determined by the synchronous speed for a range of fuel-input rates equal to or greater than the set value.

The present invention also relates to a system for improving a thermal efficiency of a heating system. In one aspect, the system according to the present invention includes a burner for receiving a combustion mixture; an igniter for igniting the combustion mixture; a means for modulating a fuel-input rate to the combustion mixture; and a combustion air blower for controlling a quantity of combustion air flow to the combustion mixture. The system further includes an alternating current electric motor, which controls the combustion air flow, and which is operable in a slip mode of operation. The speed in the slip mode increases in response to an increase in a fuel-input rate of the system. Conversely, the speed in the slip mode decreases in response to a decrease in the fuel-input rate.

In another aspect, the alternating current electric motor of the system includes and operates at a synchronous speed in a synchronous mode of operation. In this aspect, the system further includes a switch for switching between the synchronous mode and the slip mode. The alternating current electric motor switches to the synchronous mode in response to the fuel-input rate reaching a set value. The quantity of combustion air flow in the synchronous mode is determined by the synchronous speed of the motor.

In another aspect, the switch of the system includes a pressure monitor for monitoring a pressure of a fuel as the fuel-input rate varies, wherein the set value corresponds to a set pressure.

In yet another aspect, the set value is at least seventy percent of the maximum fuel-input rate.

As a result, the present invention provides a method and system for improving the thermal efficiency of any heating system which is capable of modulating or varying the fuel-input rate, using the slip mode of operation of an alternating current electric motor.

DETAILED DESCRIPTION OF THE INVENTION

The present invention provides a method and system for improving the thermal efficiency of any heating system which is capable of modulating the fuel-input rate. Such heating systems may include furnace or make-up air systems, space heaters, or heating, ventilating, and air-conditioning (HVAC) systems. The fuel-input rate may be varied in any known manner, e.g., through the use of a fuel valve.

The method includes the step of operating an alternating current (AC) electric motor, which controls the quantity of combustion air flow to the combustion mixture, in a so-called slip mode of operation to preserve thermal efficiency over a wide range of fuel-input rates. The method exploits the dependence of the motor speed on the load in the slip mode, which in turn determines the quantity of combustion air flow. As a result, the combustion air flow increases in response to increases in the fuel-input rate.

The method and system of the present invention also preferably include a synchronous mode of operation for providing a quantity of combustion air flow corresponding to a so-called synchronous speed of the motor over a second range of fuel-input rates including a maximum fuel-input rate. In the synchronous mode, the motor operates at a rated speed, referred to herein as the synchronous speed, corresponding to the full-rated torque characteristic of that particular motor.

Figure 1:
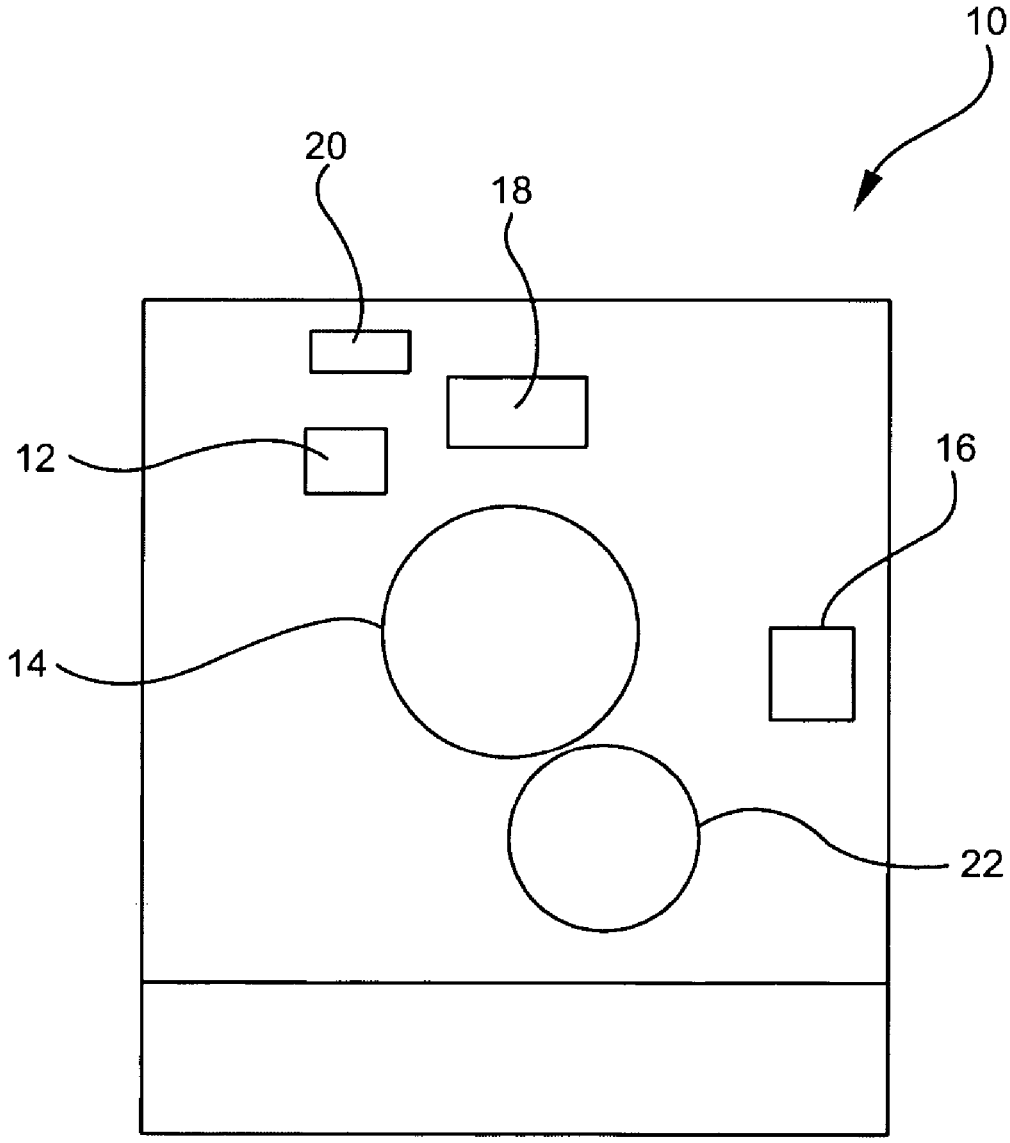
FIG. 1 Prior Art
FIG. 1 is a block diagram describing basic components of a prior art variable fuel-input rate heating system.

Referring to FIG. 1, a typical prior art variable fuel-input rate system 10 includes a means 12 for varying the fuel-input rate, a combustion air blower 14, an AC electric motor 16 for operating the blower 14, and a burner 18. The burner 18 receives the fuel and combustion air mixture, which is ignited by an igniter, such as an ignition gun 20, during the combustion process. In addition, a damper 22 may be included to open or close a combustion air bypass, which allows two levels of combustion air flow.

In the prior art system 10, the motor 16 is operated well below the full-torque rating to assure the motor operates at the rated or synchronous speed. As is well-known to those skilled in the art, the "no-load" speed (s) of an AC motor is directly proportional to a frequency (f) of the electric source powering the motor 16, according to the relationship: $s=2f/N$, where N is the number of poles in the motor. The rated speed referred to herein as the synchronous speed is typically less than the true "no-load" speed for the motor, as is known by those skilled in the art. For example, a two-pole motor for 60-hertz operation has a no-load synchronous speed of 3600 rpm and the typical rated speed is in a range of about 3250 to 3300 rpm.

In normal usage, including for use in a conventional heating system or combustion venter application, the electric strength of a motor, known to those skilled in the art as the torque rating, is typically chosen to be about 10% greater than the torque required at full input rate. In this way, it is assured that the motor 16 will operate at its specified synchronous speed when a specified load is applied. In addition, the synchronous speed will stay relatively constant over a broad range of supply voltages, since the torque-speed curve at the upper end of the curve is relatively flat. The typical single full input rate application capitalizes on that characteristic.

Figure 2:
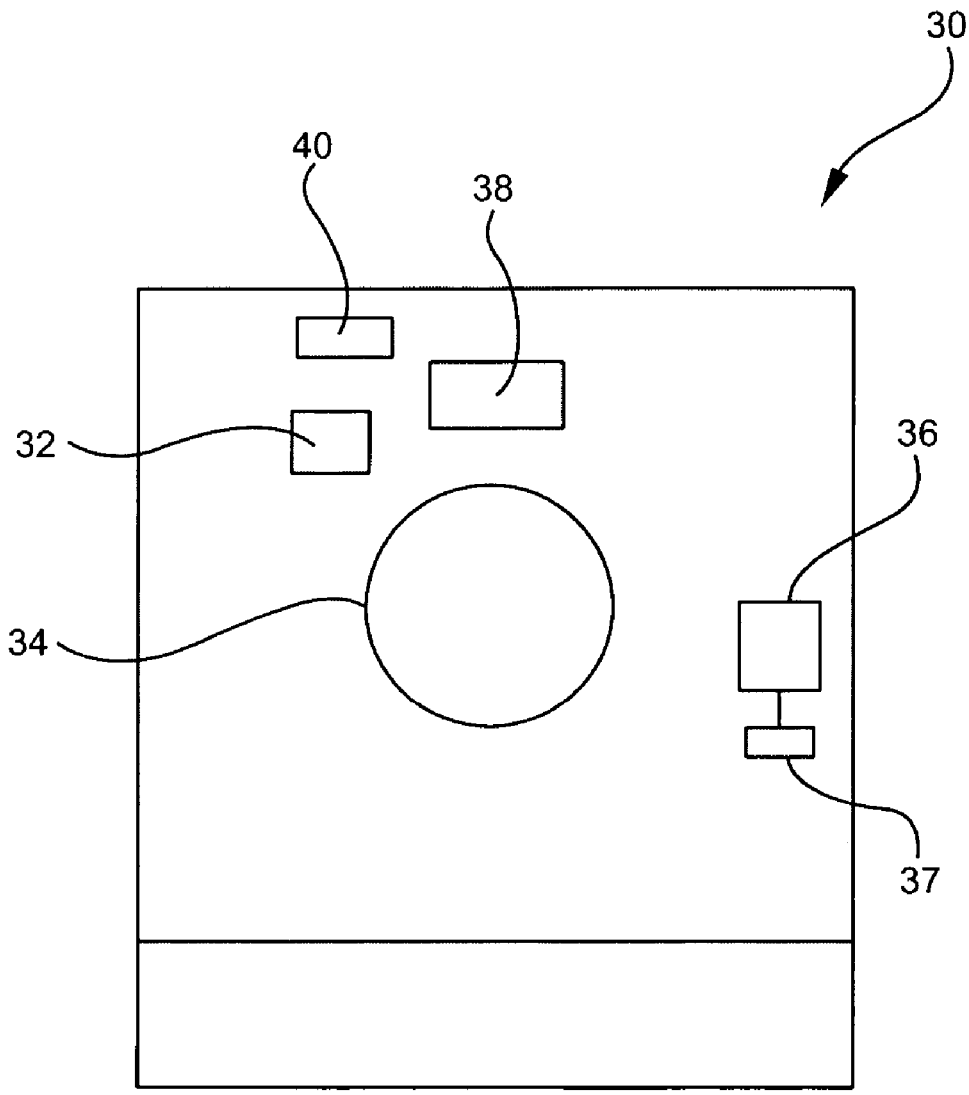
FIG. 2 is a block diagram describing basic components of a modulated fuel-input rate heating system formed in accordance with the present invention.

FIG. 2 is a block diagram showing components of a modulated fuel-input rate heating system 30 of the present invention having good thermal efficiency across the full modulated range.

The system 30 includes a means 32 for varying the fuel-input rate and, preferably, a combustion air blower 34 or other means for controlling the flow of air into the combustion mixture. In addition, the system 30 includes an AC electric motor 36 which can be operated in a slip mode, and preferably also in a normal or synchronous mode. The system 30 preferably also includes a switch 37 operatively connected to the motor 36 to switch between the slip mode and synchronous mode. The AC motor 36 operates the blower 34. The system 30 preferably also includes a burner 38 for receiving the fuel and combustion air mixture and a gun 40 for igniting the mixture during the combustion process.

Figure 3:
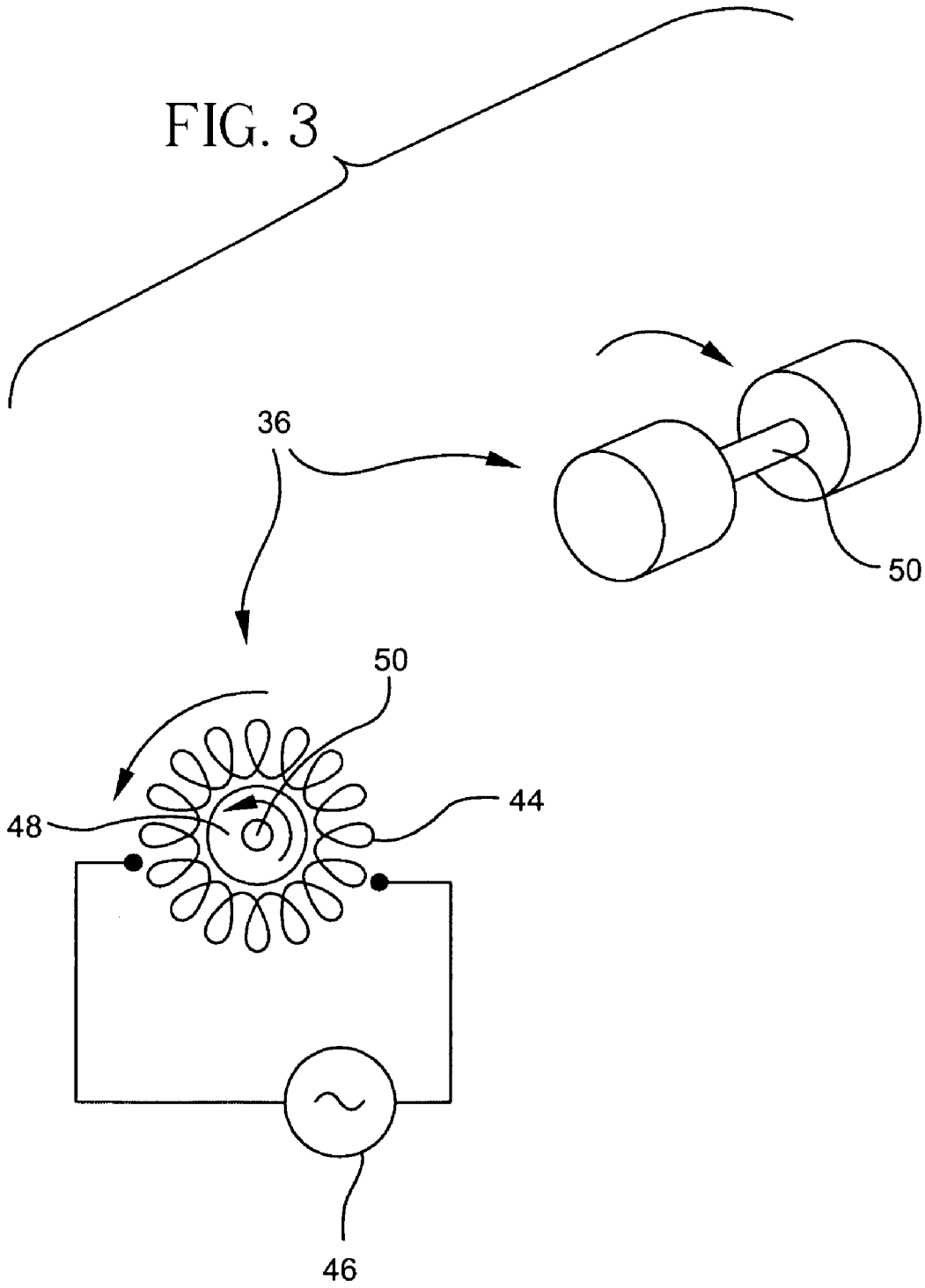
FIG. 3 is a schematic representation of an alternating current (AC) electric motor of the present invention.

Referring to FIG. 3, the motor 36 according to the method and system of the present invention may include any AC motor known to those skilled in the art for use in such heating systems, and which can operate in the slip mode, such as a squirrel cage motor or a wound rotor motor.

As shown in FIG. 3, the motor 36 may be represented simply as a stator winding 44 through which alternating current flows from the power source 46, which causes an induced electromagnetic field on a rotor 48 and rotates a shaft 50. In typical operation, the speed of rotation is the full torque-rated or synchronous speed. Even in the best circumstances, however, the synchronous speed will generally not be a constant. Therefore, those skilled in the art will recognize that the synchronous speed as referred to herein means a design value provided by the manufacturer, give or take some percentage of reduction or increase from the design value. This percentage is generally provided by the manufacturer, and typically includes a margin of error of about three to four percent from the design value over which the synchronous speed may vary during operation.

In contrast to the use of an AC motor in prior art heating systems, the AC electric motor 36 of the present invention is operated in a so-called slip mode to preserve the thermal efficiency of the heating system over a wide range of modulated fuel-input rates. The slip mode corresponds to the known condition in which a speed of an AC motor slips, or decreases, below the synchronous speed when too much load is added, so that its torque rating is effectively reduced. Essentially, the operating point of the motor is shifted off the flat portion of the characteristic torque-speed curve so that the motor is sensitive to load change in the slipped mode.

In common usage, slippage is undesirable and avoided by proper choice of operating parameters. In many cases, to assure constant speed of operation, a closed loop or controller may even be used with the AC motor. In the method of the present invention, however, the subtle change in speed of an AC motor that occurs with a change in load due to slippage is exploited.

The fuel-input rate according to the present invention is variable within a desirable range of operation in the slipped mode. This range may include either a continuous or incrementally stepped range of fuel-input rates from a lowest fuel-input rate up to and including a highest fuel-input rate. The lowest and highest fuel-input rates are provided herein as a percentage of the maximum fuel-input rate which may be provided by the heating system.

In one embodiment, the lowest fuel-input rate is equal to or greater than about 20 percent and less than or equal to about 25 percent of the maximum fuel-input rate of the heating system. In another embodiment, the lowest fuel-input rate is 30 percent or less of the maximum fuel-input rate. In an additional embodiment, the highest fuel-input rate is equal to or greater than about 60 percent and less than or equal to about 70 percent of the maximum fuel-input rate. In still another embodiment, the highest fuel-input rate is equal to or greater than 50 percent of the maximum fuel-input rate.

The method of the present invention preferably includes the step of initially setting a reduced torque rating and an initial slip speed for operation with the lowest fuel-input rate in the slip mode. One skilled in the art will recognize that the initial slip speed and lowest fuel-input rate are chosen to provide a sufficient quantity of combustion air flow for satisfactory combustion quality and thermal efficiency at the lowest fuel-input rate. The combustion quality and thermal efficiency are achieved by maintaining a proper air/fuel mixture according to known stoichiometry.

In one embodiment of the method and system of the present invention, a speed reduction from the synchronous speed can be obtained by tapping the windings 44 (see FIG. 3) to utilize only a portion of them in order to set an initial operating point for the motor at the initial slip speed. In another embodiment, a resistance may be added in series with the windings 44 to reduce the speed of the motor and set an initial slip speed in the slip mode. In yet another embodiment, the electric energy to the motor may be reduced, for example, by wave-chopping the AC line voltages according to methods well-known to those skilled in the art.

Preferably, the initial slip speed is chosen to provide a thermal efficiency of at least 80 percent.

In one embodiment, the initial slip speed is greater than or equal to about 50 percent of the synchronous speed and less than or equal to about 60 percent of the synchronous speed. In another embodiment, the initial slip speed is less than or equal to about 70 percent of the synchronous speed.

In one particular embodiment, the lowest fuel-input rate is equal to or greater than about 20 percent and less than or equal to about 25 percent of the maximum fuel-input rate of the heating system, and the initial slip speed is greater than or equal to about 50 percent and less than or equal to about 60 percent of the synchronous speed.

In the slip mode, including at the initial slip speed, the motor's operational speed is extremely sensitive to voltage change and load change. Referring to FIG. 2, the combustion air blower 34 will move a fixed volume of combustion air at the initial slip speed and lowest fuel-input rate. As the fuel-input rate is increased, thereby raising the temperature of the flue gas, a density of the fixed volume of air decreases. Because of the lowered density, the load on the motor and the torque required to move the fixed volume also decreases. When the load decreases, the speed of the motor increases from the initial slip speed until the load matches the initial reduced torque rating.

Conversely, when the fuel-input rate is decreased within the range of allowable fuel-input rates in the slip mode, the air density increases, the load increases, and the speed of the combustion air blower and quantity of combustion air flow decreases.

As a result, the combustion air flow increases in response to an increase in fuel-input rate, and decreases in response to a decrease in fuel-input rates within the range of allowable fuel-input rates in the slip mode. The responsive change in air flow acts to maintain a constant combustion air to fuel ratio to the burner 18, so that an acceptable combustion quality and substantially constant thermal efficiency are maintained across the range of fuel-input rates in the slip mode. This automatic speed adjustment of the motor in response to the changing load occurs over a wide range of fuel-input rates, preferably up to at least 80 percent of the maximum fuel-input rate.

A substantially constant thermal efficiency as used herein means a substantially constant fuel to combustion air ratio, as known to those skilled in the art and as determined through stoichiometry, which is maintained by increasing the combustion air in proportion to the amount of fuel to maintain a desired thermal efficiency, preferably of at least 80%. In practice, as will be appreciated by those skilled in the art, the thermal efficiency can only be "substantially constant" to within the manufacturing tolerances of the devices providing the fuel-input and combustion air flow. For example, the speed of the motor may vary independently due to fluctuations in the AC power source by up to ±5 percent.

Preferably, the AC motor 36 of the present invention is characterized by a slip speed that increases linearly within the desired range of fuel-input rates in the slip mode. The actual proportional increase in the speed of the motor 36 from the initial slip speed to set the increase in combustion air flow in response to the increase in fuel-input rate may be adjusted according to methods well-known to those skilled in the art.

The method of the present invention also preferably includes switching to the synchronous mode of operation in response to the fuel-input rate reaching a predetermined set value. The predetermined set value is preferably equal to or greater than the highest fuel-input rate of the slip mode. In other words, preferably when the fuel-input rate equals or just exceeds the highest input rate, the electric motor switches to the synchronous mode of operation. Therefore, a range of fuel-input rates in the synchronous mode includes fuel-input rates greater than the highest fuel-input rate of the slip mode up to and including the maximum fuel-input rate available.

In the synchronous mode, the motor 36 is operating in a range preferably well below its full-load torque rating to assure that small changes in voltage or load preferably have little effect on the speed of the motor. Therefore, the quantity of combustion air flow in the synchronous mode is determined by the synchronous speed, as in conventional systems. Accordingly, one skilled in the art will appreciate that in this mode, the synchronous speed is chosen to provide a combustion air flow that will provide adequate thermal efficiency and combustion quality over the synchronous operating range of fuel-input rates.

The switching step may be provided by a switch which is activated, for example, by a pressure change of the fuel at some point after the fuel valve or other means used to adjust the fuel-input rate. The set value corresponds to a set pressure, so that when the pressure increases beyond a set pressure, which is related to changes in fuel-input rate, the mode of operation switches to the synchronous mode.

Figure 4:
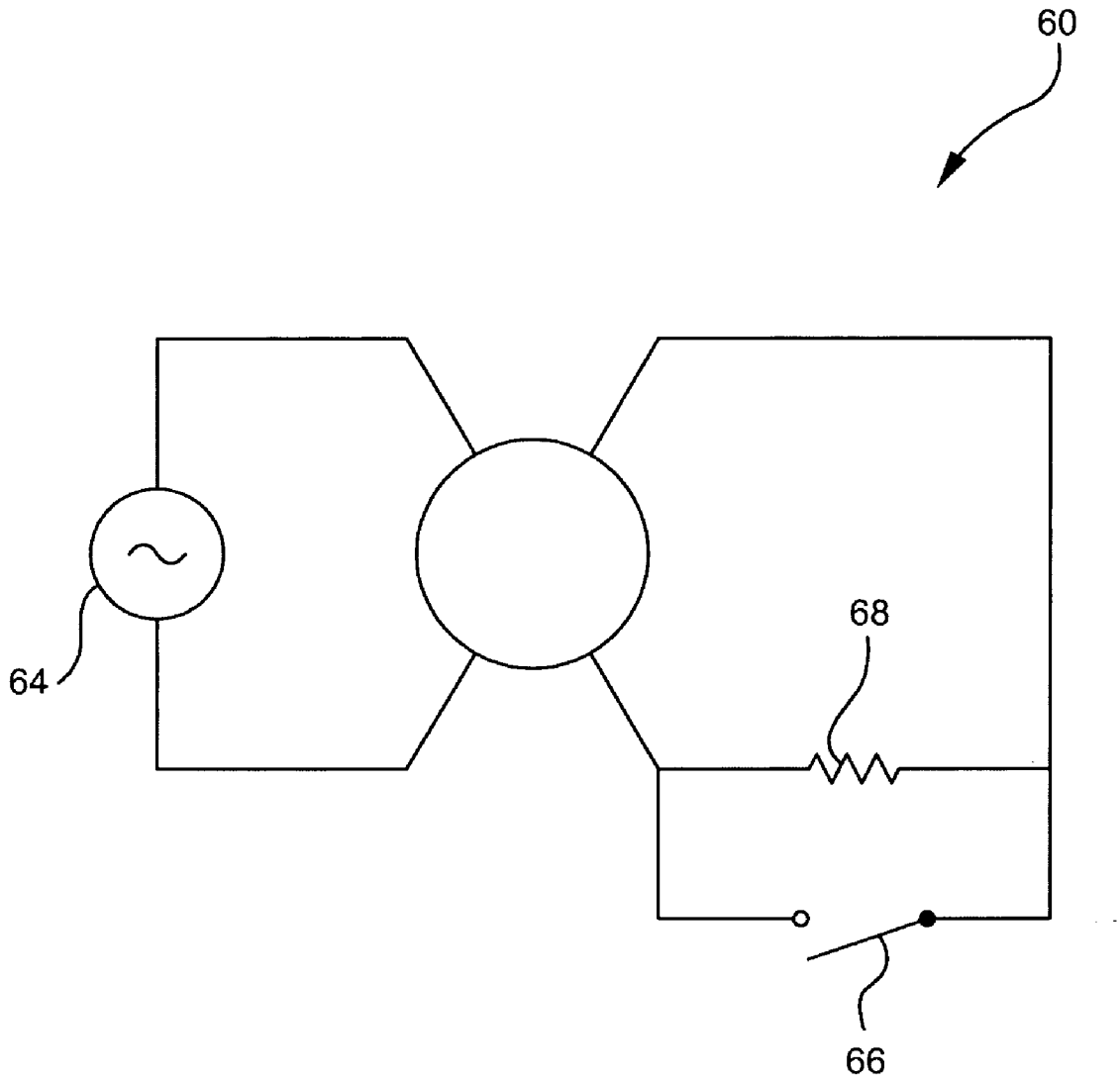
FIG. 4 is an electric circuit schematic representation of an AC motor with two modes of operation according to the present invention.

Referring to FIG. 4, one embodiment of a system according to the present invention includes an electric circuit 60 for switching between modes of a wound rotor or other type of AC electric motor 62, for which resistance may be added in series with the windings to set an initial slip speed in the slip mode. An AC source 64 provides AC power to the motor 62. A switch 66 is included which is activated by any indicator of a change of fuel-input rate, including, for example, pressure of the fuel at intake. When the switch 66 is in the open position, a resistance 68 is preferably added in series with the resistance of the windings. This increased resistance increases the load on the motor 62, resulting in an effectively reduced torque rating, and is chosen to set an initial slip speed as discussed above. If the fuel-input rate reaches the set value, for example, a set pressure value, required to trigger the switch 66 to close, the resistance 68 is short circuited, so that the total resistance is provided only by the windings. The minimal resistance of the circuit 60 corresponding to the windings is preferably at a level that allows the AC motor 62 to operate in the synchronous mode at the maximum fuel-input rate. As the fuel-input rate varies between the initial set value that closes the switch, and the maximum fuel-input rate, the combustion air flow preferably remains substantially constant.

One skilled in the art will recognize that the circuit 60 shown is a simplistic model and that variations thereof, including, for example, the addition of capacitors to prevent spiking upon opening and closing of the switch and diodes to control current flow, are within the scope of the system of the present invention.

In another embodiment, a switch is provided for switching between a slip mode and a synchronous mode. An initial slip speed is set by tapping the windings of a motor. When activated to switch to the synchronous mode, the switch allows the full windings to be accessed so that the motor is fully energized, according to methods well-known to those skilled in the art.

In yet another embodiment, a switch allows switching between the slip mode and the synchronous mode, where the system includes a device for wave-chopping the AC line voltages to reduce energy to the motor in the slip mode according to methods well-known to those skilled in the art. When switching to the synchronous mode, the switch turns off the wave-chopping device to fully energize the motor.

In the synchronous mode range of fuel-input rates, for example, for fuel-input rates from at least 70 percent of the maximum up to and including the maximum fuel-input rate, the thermal efficiency will not be constant. However, one skilled in the art will recognize that with proper choice of the operating synchronous speed, the thermal efficiency will still be satisfactory across this synchronous operating range.

One advantage of the method and system formed in accordance with the present invention is that good thermal efficiency and combustion quality are maintained across a wide range of fuel-input rates, for example, from about 20 percent of the maximum rate up to and including the maximum rate. In addition, no complex electronic control circuitry or expensive mechanical equipment is required.

Example

An embodiment of a method and system of the present invention was tested for ten different input capacity furnaces, ranging in gas input capacities from 75 MBH to 400 MBH.

To cover this range of different input capacities, four AC electric motors with different torque ratings were tested. Each motor was chosen to provide a torque rating sufficient to provide an adequate amount of combustion-air at maximum fuel-input rate, also referred to herein as full fuel-input rate, for the largest furnace that it was intended to be used on.

For the testing, 70 percent of the full gas input rate was selected as the set value, or transfer point, at which the system would switch between the slip mode and the synchronous mode. From a gas input rate of 100 to 70 percent, the motor was operated at its maximum torque rating by applying full line voltage. Below 70 percent, the electric energy inputted to the motor was reduced to slow the speed of the motor and reduce the quantity of combustion-air. To reduce the electric energy input to the motor, a commercially available device that is used to control the speed of ventilator fans was used. The device reduced the electrical energy by wave-chopping the AC line voltages.

To determine the proper amount of energy reduction needed, empirical testing was performed. An electrical energy input for each furnace capacity suitable to provide sufficient combustion-air for safe and efficient operation over a gas input of 22 to 70 percent of the full gas input was determined.

To demonstrate the favorable "slip" characteristics, the motor speed at 22 percent of full input rate for a 200 MBH furnace was recorded as 2195 rpm. With the same control board setting, at 70 percent of full input rate the motor speed increased to 2525 rpm.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A system for improving the thermal efficiency of a heating apparatus, the system comprising:

a burner for receiving a combustion mixture;

an igniter for igniting the combustion mixture;

a means for modulating a fuel-input rate to the combustion mixture;

a combustion air blower for controlling a quantity of combustion air flow to the combustion mixture;

an alternating current electric motor operable within a range of speeds in a slip mode of operation for operating the combustion air blower, wherein the speed in the slip mode increases in response to an increase in the fuel-input rate of the system, wherein the alternating current electric motor includes a synchronous mode of operation, the electric motor operating at a synchronous speed when in the synchronous mode; and a switch for switching between the synchronous mode and the slip mode, wherein the electric motor switches to the synchronous mode in response to the fuel-input rate reaching a set value, wherein the quantity of combustion air flow from the combustion air blower in the synchronous mode is determined by the synchronous speed.

2. The system of claim 1, wherein the switch comprises a pressure monitor for monitoring a pressure of a fuel as the fuel-input rate varies, wherein the set value corresponds to a set pressure.

3. The system of claim 1, wherein the set value is a percentage of a maximum fuel-input rate.

4. The system of claim 3, wherein the set value is at least seventy percent of the maximum fuel-input rate.

5. The system of claim 1, wherein the combustion air flow is adjusted in response to the fuel input rate in the slip mode to maintain a substantially constant fuel to combustion air ratio, and wherein the flow of the combustion air flow in the synchronous mode is determined by the synchronous speed.

6. The system of claim 5, wherein the system operates in the synchronous mode for the fuel-input rate equal to or greater than the set value.

* * * * *